US009932716B2

(12) United States Patent
Pickup et al.

(10) Patent No.: US 9,932,716 B2
(45) Date of Patent: Apr. 3, 2018

(54) FOLDABLE BARRIER STRUCTURE

(71) Applicant: HESCO BASTION LTD., Leeds, Yorkshire (GB)

(72) Inventors: Mike Pickup, Leeds (GB); Kenny Scott, Leeds (GB)

(73) Assignee: HESCO BASTION LTD., Leeds, Yorkshire (GB)

( * ) Notice: Subject to any disclaimer, the term of this patent is extended or adjusted under 35 U.S.C. 154(b) by 0 days.

(21) Appl. No.: 14/912,854

(22) PCT Filed: Aug. 29, 2014

(86) PCT No.: PCT/GB2014/052631

§ 371 (c)(1),
(2) Date: Feb. 18, 2016

(87) PCT Pub. No.: WO2015/028819

PCT Pub. Date: Mar. 5, 2015

(65) Prior Publication Data

US 2016/0201282 A1 Jul. 14, 2016

(30) Foreign Application Priority Data

Aug. 29, 2013 (GB) ..... 1315403.4
Jun. 9, 2014 (GB) ..... 1410213.1

(51) Int. Cl.
*E02B 3/10* (2006.01)
*E02B 3/12* (2006.01)
(Continued)

(52) U.S. Cl.
CPC ..... *E02B 3/108* (2013.01); *B65D 88/1625* (2013.01); *E02B 3/12* (2013.01);
(Continued)

(58) Field of Classification Search
CPC ..... E02B 3/108; E02B 3/127; E02D 29/0291
(Continued)

(56) References Cited

U.S. PATENT DOCUMENTS 3,213,628 A * 10/1965 Serota ..... E02B 3/108 220/62.21
4,594,206 A * 6/1986 Grafton ..... E02B 3/06 264/257

(Continued)

FOREIGN PATENT DOCUMENTS

DE 102008026647 A1 * 4/2010 ..... E02B 3/108
EP 0 816 572 A2 7/1998

(Continued)

OTHER PUBLICATIONS

Examination Report under Section 18(3), Application No. GB 1410213.1 dated Sep. 30, 2014.

(Continued)

*Primary Examiner* — Frederick L Lagman
(74) *Attorney, Agent, or Firm* — Ping Wang; Andrews Kurth Kenyon LLP

(57) ABSTRACT

The present invention relates to a foldable barrier structure comprising a compartment bounded by a pair of opposed side walls and a pair of opposed end walls, at least one pair of opposed side or end walls being formed from a flexible, foldable material incorporating a stiffening element and a means for receiving a hinge member which permits folding of a central region of each opposed side or end wall of the at least one pair of side or end walls. Also provided is a multi-compartmental foldable barrier structure comprising a multiplicity of such compartments connected, affixed or adhered to one another end to end, as well as a flood defense barrier comprising a first multi-compartmental foldable barrier structure provided with a continuous length of water impermeable material extending across the individual struc- (Continued)

tures along at least one side of the barrier; a second multi-compartmental foldable barrier structure provided with a continuous length of water impermeable material extending across the individual structures along at least one side of the barrier; and fastening means for fastening the first multi-compartmental foldable barrier structure to the second multi-compartmental foldable barrier structure.

7 Claims, 7 Drawing Sheets

(51) Int. Cl.
*E02D 17/18* (2006.01)
*E02D 29/02* (2006.01)
*B65D 88/16* (2006.01)

(52) U.S. Cl.
CPC ..... *E02D 17/18* (2013.01); *E02D 29/025* (2013.01); *E02D 29/0266* (2013.01); *E02D 29/0291* (2013.01)

(58) Field of Classification Search
USPC ..... 383/119
See application file for complete search history.

(56) References Cited

U.S. PATENT DOCUMENTS 4,781,475 A * 11/1988 LaFleur ..... B65D 88/1618 383/119
4,807,299 A * 2/1989 Nattrass ..... B65D 88/1681 383/109
4,903,859 A * 2/1990 Derby ..... B65D 88/1625 217/36
5,358,335 A 10/1994 LaFleur
6,012,872 A 1/2000 Perry et al.
6,164,870 A * 12/2000 Baruh ..... E02B 3/108 405/114
6,415,927 B1 * 7/2002 Stone ..... B65D 19/06 206/600
7,011,224 B2 * 3/2006 Sheng-Bin ..... B65D 15/22 220/6
7,431,534 B2 10/2008 Harbeck
7,594,581 B2 * 9/2009 Lapoint, III ..... B65D 5/3628 220/4.28
8,672,585 B2 * 3/2014 Schnaars, Sr. ..... E02B 3/108 405/111
8,721,221 B2 5/2014 Cavenagh et al.
9,085,866 B2 * 7/2015 Schnaars, Sr. ..... E02B 3/108
9,175,451 B2 * 11/2015 Schnaars, Sr. ..... E02B 3/108
9,260,830 B2 * 2/2016 Schneider ..... E02B 3/108
2006/0054620 A1 * 3/2006 Liu ..... B65D 11/1853 220/6
2006/0222270 A1 * 10/2006 Modena ..... B65D 88/1612 383/38
2007/0140598 A1 * 6/2007 McGillick, Sr. ... B65D 88/1612 383/22
2007/0154264 A1 * 7/2007 Baruh ..... E02B 3/108 405/110
2008/0247830 A1 * 10/2008 Heselden ..... E02D 29/0208 405/273
2010/0064627 A1 * 3/2010 Heselden ..... E02D 29/0208 52/745.09
2011/0033236 A1 2/2011 Heselden
2011/0305511 A1 12/2011 Heselden
2012/0207406 A1 * 8/2012 Cavenagh ..... E02B 3/108 383/38

FOREIGN PATENT DOCUMENTS

EP 1 614 811 A1 1/2006
EP 1 731 678 A1 12/2006
EP 2532789 A1 * 12/2012 ..... E02B 3/108
GB 2432611 B 2/2010
GB 2493007 A 1/2013
GB 2502152 A 11/2013
GB 2503739 A 1/2014
NL 1 010 700 C2 6/2000
WO 97/20758 A1 6/1997
WO 2005/080691 A1 1/2005
WO 2009/109735 A1 9/2009
WO 2010/029349 A3 3/2010
WO 2012/107745 A1 8/2012

OTHER PUBLICATIONS

Combined Search and Examination Report under Sections 17 & 18(3), Application No. GB 1315403.4 dated Jan. 31, 2014.
International Search Report and Written Opinion of International Searching Authority of International Application No. PCT/GB2014/052631 dated Nov. 11, 2014.

* cited by examiner

FOLDABLE BARRIER STRUCTURE

The present invention relates to foldable barrier structures, particularly those which can be deployed quickly and easily, are self-supporting and can be removed from the deployment site without leaving behind contaminated fill material.

Collapsible bags have long been used in industry for storing and transporting material, for example sand, gravel and the like. These collapsible bags are frequently formed from flexible material, for example polypropylene or polyethylene fabric which offer advantages such as good tear resistance, moisture permeability, and being light weight and reusable. However, conventional collapsible bags have numerous problems associated therewith. In particular, they are not self-supporting until filled with a material. In this case, the collapsible bag must be held upright and open using machinery or manpower whilst being filled with material, thus making the process of filling the collapsible bag difficult and time consuming.

It is also known to use a plurality of connected collapsible bags to form barriers, for example flood defence barriers. However, the problems associated with collapsible bags as outlined above, are increased in larger structures i.e. barriers, as each individual bag within the structure must be held upright and open whilst being filled.

Flooding is a growing problem in many parts of the world. It is commonly dealt with by erecting barriers to keep rising water levels out of certain areas. Such barriers generally have to be erected quickly and easily, especially as weather conditions are often adverse just before flooding occurs. Additionally, there is often little or no prior warning of flooding and so it would be beneficial to be able to use materials readily available at the site at which the barriers are to be deployed.

Commonly used flood barriers comprise bags filled with soil or sand, which are then wrapped in a water impermeable material such as polyethylene. This process can be time consuming and cannot be guaranteed to result in a strong, fully water impermeable barrier. It is common for small gaps to occur in between the bags, especially at their base. Water can then pass through these gaps, resulting in leakage. The amount of water passing through the barrier depends on the force of the flood, though it can be significant. The force of the water can also create a channel in the ground underneath the barrier, thereby increasing the amount of water that can pass through the barrier.

Once the flooding has subsided, disposal of the material that was used to fill the bags also becomes problematic. The fill material is generally contaminated with materials such as sewage that are present in the floodwater, which seeps into the bag during the flooding. Unfortunately, it is common practice to remove the barriers by simply cutting open the bags and removing the contaminated fill material, which is generally left at the site. This practice has both environmental and safety consequences for the surrounding area.

EP1731678 discloses a flood barrier comprising a plurality of individual compartments. These compartments are attached by screws, nails, clamps or the like, which extend between adjacent side walls of adjacent individual compartments. A plurality of individual compartments can be connected to form a unit and two units can be attached together in the same manner as the individual compartments within each unit are connected, i.e. using screws, nails, clamps or the like.

Whilst this offers some improvements, there is still a need for a flood barrier that is quick and easy to erect, with improved leakage resistance and that allows removal of the contaminated fill material from the site.

A first aspect of the present invention provides a foldable barrier structure comprising a compartment bounded by a pair of opposed side walls and a pair of opposed end walls, at least one pair of opposed side or end walls being formed from a flexible, foldable material incorporating a stiffening element and a means for receiving a hinge member which permits folding of a central region of each opposed side or end wall of the at least one pair of side or end walls.

The use of a stiffening member in combination with a flexible, foldable material provides a structure that can easily be compressed to a small volume, as the resistance to the folding is only in the flexible material, which incorporates a means for receiving a hinge member. However, the structure may be self-supporting once it has been erected as a result of the stiffening material. Further, the structure is not too heavy and can also be made relatively cheaply.

What is meant by 'self-supporting' is that the structure is capable of standing upright and open prior to being filled with material. Thus, the structure does not necessarily have to be held upright and open manually prior to filling.

The means for receiving a hinge member may comprise a discontinuity in the stiffening element. This discontinuity may be a less thick region of the stiffening element, or a break in the stiffening element such that the stiffening element comprises at least two sections.

Each opposed side or end wall of the at least one pair of side or end walls of the foldable barrier structure may have a width extending from its first end to its second end, and its central region extends from the centre of the wall equidistantly towards each of the first and second ends of the wall and has a width of up to 90%, 80%, 70%, 60%, 50%, 40%, 30%, 20%, 10% or 5% of the width of the wall. By width, it is meant the distance between the point at which the side wall meets one end wall and the point at which the side wall meets the other end wall, or the distance between the point at which the end wall meets one side wall and the point at which the end wall meets the other side wall.

This allows the structure to be easily folded as the central region of the wall comprises the means for receiving a hinge member. Further, this allows the structure to reach a small volume, as the central region of the walls must have sufficient width to allow the structure to fold.

The stiffening element may be incorporated with the flexible material by means selected from one or more of:

a) adhering the stiffening element to the flexible material;
b) affixing the stiffening element to the flexible material by affixing means provided within the central region of the stiffening element and substantially away from the top and the bottom of the wall;
c) laminating the stiffening element with the flexible material; and/or
d) enclosing at least a major portion of the stiffening element within the flexible material.

Such means ensure that the stiffening means cannot easily separate from the flexible material, as well as being relatively cheap and easy to manufacture.

The incorporation of the stiffening element with the flexible material may be such that the stiffening element is embedded in or on the flexible material. This may be by way of a pocket formed in the flexible material into which the stiffening element is placed. The pocket may be formed by stitching an additional wall into a respective wall of the compartment i.e. the side or end walls. The stiffening member may be a complementary shape to the pocket, for example the stiffening member may be substantially square or rectangular-shaped. One advantage of having the stiffening member positioned within a pocket is that the stiffening member is held in the correct position within the collapsible bag without the need for additional fixing means, for example screws, nails and/or clamps.

The stiffening element may be:

a) not a metallic mesh-form material;

b) not a metallic material; and/or c) is a plastics material.

Such materials are cheap, light and readily available, as well as providing the required stiffness.

The stiffening element may be manufactured from a material which is:

a) different from the flexible material; or b) the same as the flexible material, and having thickness substantially greater than that of the flexible material.

The material used to produce the stiffening element should be selected based on the requirements of the structure. A material different from the flexible material may provide thinner stiffening elements than using the same material as the flexible material and so the structure may be compressed to a smaller volume. However, such a stiffening element may be more expensive than a stiffening element made from the same material.

The stiffening element may be provided in the form of at least a first section and a second section, the means for receiving a hinge member being provided between the said first and second sections.

This provides a stiff wall that can easily be folded so as to collapse the structure, as the two sections of the stiffening element can move relative to one another, about the means for receiving a hinge member.

The means for receiving a hinge member may be provided by the flexible, foldable material in a region between the said first and second sections, or extending over or under the said region. This is a cheap, easily manufactured and durable way to provide the means for receiving a hinge member, as no additional parts are required.

In one embodiment, the means for receiving a hinge member comprises a central region of the wall, with the first and second sections either side of this region. In this region, two layers of the flexible, foldable material can be joined. The join may be in the form of a stitched seam, running from the top of the wall to the bottom. This would create two pockets, either side of the join, into which a first section and a second section of the stiffening element may be inserted. In this way, the wall is stiffened by the two sections of the stiffening element, but the join running in between the two provides the means for receiving a hinge member, which allows the structure to be folded as required.

In another embodiment, the walls comprise the join discussed above as a means for receiving a hinge member. However, a pair of opposed walls only comprises two sections of the stiffening element, one on the first wall and one on the second. The two sections should be diagonally opposite one another (i.e. should be on opposite sides of the seam). This provides a light and cheap arrangement with sufficient stiffness to be self-supporting, that can be folded or rolled into a reduced volume, pre-deployment configuration, thereby reducing transportation costs.

A stiffening member may be positioned at both of the side walls and one or both of the end walls, or at both of the end walls and one or more of the side walls. The end walls and the side walls may be formed from the same or a different material.

The stiffening element may comprise one or more panels. Optionally, the one or more panels may comprise one or more closed panels. Such panels are cheap, light and readily available.

The structure may have a base wall formed from a flexible, foldable material. This acts to improve the stability of the structure as the fill material placed in the structure weighs down the base wall, thereby improving the stability of the structure as a whole. Having the base wall formed from a flexible, foldable material allows the base of the structure to adapt its shape to that of the surface on which it is placed.

Another aspect of the present invention provides a multi-compartmental foldable barrier structure comprising a multiplicity of compartments as discussed above, connected, affixed or adhered to one another end to end. Such a barrier is rapidly and easily deployed, as well as being light and cheap to manufacture.

The multi-compartmental foldable barrier structure may fold in an accordion-like manner. This allows the barrier to be compressed to a small volume when it is not deployed, which makes transporting the barrier to the intended site of deployment easier.

Some or all of the individual compartments can contain a fill material. Preferably, all of the individual compartments contain a fill material. The fill material may be selected from sand, earth, soil, stones, rocks, rubble, concrete, debris and combinations of two or more thereof. This fill material provides stability to the barrier and is preferably a material found naturally around the deployment site.

A means for preventing a fill material from falling between adjacent individual compartments may be present. This is particularly important when the fill material is being introduced to the compartments, especially when the fill material is a fine material such as sand. This means may comprise a material extending between the compartments and fastened to the inside of each of the side walls adjacent to the other individual compartment. The material may be fastened by, for example, staples or stitches. Optionally, the means may be attached to the inside of one of the side walls adjacent to the other individual compartment and can subsequently be attached to the other side wall.

Some or all of the individual compartments may comprise an openable base. This allows the fill material to be easily released from the individual compartments once the barrier is dismantled. Preferably, the base remains closed until such an openable feature is used, so that the compartments, including the fill material, can be removed from the site of deployment. The fill material can then be released as and when is appropriate. However, the base is preferably flat and/or smooth, so as to minimise potential passages for materials such as water underneath the barrier structure. Any suitable means may be used to allow the openable base to open. In one arrangement, the openable base may comprise an opening which is held closed by a toggle mechanism or the like that can be released to allow the opening to open.

Further, some or all of the individual compartments may comprise a lifting means. Such a lifting means may comprise handles on the top edges of the individual compartments. The lifting means helps the individual compartments to be removed from the barrier when it is being dismantled. Any number of handles may be used, for example 1, 2, 3, 4 etc. In one arrangement, a handle is positioned on each of the four corners on the top edge of the collapsible bag. The lifting means may aid transportation of the collapsible bag, particularly when it is filled.

Preferably, the individual compartments are bags. Each individual compartment preferably comprises side walls and a base. Preferably, the individual compartments are designed to tessellate and so may, for example, be cuboid. The collapsible bag may be any suitable size. Preferably, the size of the bag is such that it may be used, on its own, or in association with other similar bags, to provide an effective barrier for flood defence or military or security purposes. For example the bag may have a height of at least 50 cm, 75 cm or 100 cm; it may have a width of at least 50 cm, 75 cm or 100 cm; and/or it may have a depth of at least 50 cm, 75 cm or 100 cm. Where the collapsible bag is cube-shaped, for example, it may have dimensions of 100 cm×100 cm×100 cm.

The structures of the present invention are preferably self-supporting. The structures are therefore capable of standing erect before a fill material is inserted. In order to achieve this, some or all of the individual compartments comprise a stiffening element to provide or enhance rigidity. The stiffening element may be present on all sides of the individual compartment. The stiffening element may be any suitable material and may comprise one or more of a geogrid, wood and/or polypropylene. By geogrid, it is meant a material that is conventionally used for grass or soil reinforcement. Preferably, the stiffening member is formed from a plastic, for example polypropylene or polyethylene. In one embodiment, the stiffening member is formed from a corrugated polypropylene sheet, for example Correx® manufactured by Alligata®.

This stiffening element can be inserted as one or more panels. The panels may be placed against the inside of a side wall of an individual compartment, or may be inserted into a pocket formed within a side wall of an individual compartment. The pocket can then be closed, sealing in the panel. Two adjacent panels may be used on each of two opposite side walls, such that the side walls can fold at a point along their length. This allows the barrier to concertina when not filled. Additionally or alternatively, the side walls adjacent to another individual compartment may comprise one panel, while the side walls perpendicular thereto may comprise two panels, such that the perpendicular side walls can fold to allow the barrier to be compressed. The panels may not extend along the entire length of the side wall, which allows the walls to fold and thereby allows the barrier to be compressed.

The walls may be formed from any suitable material with sufficient flexibility to allow the bag to be collapsed, for example folded or rolled, into a pre-deployment configuration. Desired characteristics of the wall material include, either alone or in combination: flexibility, durability, toughness, tear resistance, scratch and erosion resistance, corrosion resistance, thermal stability, ultraviolet stability, low density, low cost and recyclability. Examples of suitable wall materials include plastics, for example polypropylene, polyethylene and biopolymeric materials, and combinations of one or more thereof. The plastics may be woven to form a fabric or may be in filmic form.

In certain circumstances it may be desirable to add coloured fillers to the plastic material to provide a desired aesthetic effect. Since such colours are integral with the plastic material i.e. they are not surface decoration, they are less susceptible to removal by erosion.

It may be desirable to make the wall material as thin as possible to reduce the volume of bag when it is collapsed into a pre-deployment configuration, for example during storage and transportation. A major advantage of using a thin wall material is weight and volume saving, which reduces transportation costs.

The multi-compartmental foldable barrier structure may comprise any number of individual compartments. Preferably, the number is between 2 and 15, more preferably between 5 and 12 and even more preferably, 10.

The multi-compartmental foldable barrier structure may be arranged side-by-side, so as to form a line of individual compartments that is one compartment deep. This arrangement will hereinafter be referred to as the linear arrangement.

The collapsible bags may be connected or attached using fastening means, for example nails, screws, clamps, staples or stitches. Preferably, the collapsible bags are connected or attached by stapling together adjacent walls of two collapsible bags.

Alternative fastening means include eyelets made of, for example, plastic or metal on each plurality of individual compartments, which are then connected by means such as a cable tie. The cable ties may be made of, for example, metal or plastic and may be releasable or non-releasable. Alternatively, other means such as a water impermeable zip (for example the MaxiGrip MX 20), Velcro™ or C-rings (C-shaped metal staples that are then deformed into a circle, thereby connecting the two compartments) can be used. Any number of such fastening means may be used at each join to connect two individual compartments together. When eyelets and cable ties, or C-rings, are used, there are preferably four fastening means evenly spaced along each joint between the two individual compartments. In other words, there are four fastening means at the front of the barrier between each individual compartment and four fastening means at the back of the barrier between each individual compartment.

A further aspect of the present invention provides a flood defence barrier comprising:

a. a first multi-compartmental foldable barrier structure connected together and provided with a continuous length of water impermeable material extending across the individual compartments along at least one side of the barrier;
b. a second multi-compartmental foldable barrier structure connected together and provided with a continuous length of water impermeable material extending across the individual compartments along at least one side of the barrier; and
c. fastening means for fastening the first multi-compartmental foldable barrier structure to the second multi-compartmental foldable barrier structure.

The fastening means may comprise any suitable fastening means, such as eyelets made of, for example, plastic or metal on each plurality of individual compartments, which are then connected by means such as a cable tie. The cable ties may be made of, for example, metal or plastic and may be releasable or non-releasable. Alternatively, other means such as a water impermeable zip (for example the MaxiGrip MX 20), Velcro™ or C-rings (C-shaped metal staples that are then deformed into a circle, thereby connecting the two compartments) can be used. Any number of such fastening means may be used at each join to connect two individual compartments together.

The individual compartments in each plurality may also be connected via fastening means such as those described above. Again, any number of such fastening means may be used at each join to connect two individual compartments together. When eyelets and cable ties, or C-rings, are used, there are preferably four fastening means evenly spaced along each joint between the two individual compartments. In other words, there are four fastening means at the front of the barrier between each individual compartment and four fastening means at the back of the barrier between each individual compartment.

The present invention also provides a flood defence barrier comprising a first multi-compartmental foldable barrier structure connected by a first, non-releasable fastening means, wherein the multi-compartmental foldable barrier structure comprises at least one second, releasable, fastening means effective for releasably fastening the first multi-compartmental foldable barrier structure to a second multi-compartmental foldable barrier structure.

By releasable, it is meant that the fastening means can be unfastened without destruction of the means, such that the means can be re-fastened after said unfastening. In contrast, non-releasable fastening means can only be unfastened either by destruction of the means or their removal from the barrier, so that they cannot subsequently be re-fastened. In one embodiment, the first, non-releasable fastening means comprises a continuous length of material, which may be water impermeable.

Used herein, reference to a "fastening means" refers to the fastening means for fastening the first multi-compartmental foldable barrier structure to the second multi-compartmental foldable barrier structure. Preferably, the fastening means may be provided on at least one of the compartments of a multi-compartmental foldable barrier structure. The at least one compartment provided with a fastening means may be an end compartment. Additionally or alternatively, the complementary fastening means of a second multi-compartmental foldable barrier structure may be on an end compartment. Preferably the fastening means can be fastened and optionally also unfastened without the need for additional equipment.

The individual compartments of the present invention may be self-contained units, which are connected by a non-releasable fastening means, which may be a continuous length of water impermeable material extending across the individual compartments along at least one side of the barrier. At least part of each individual compartment may comprise a water impermeable material. The term "side walls adjacent to another individual compartment" used herein refers to adjacent side walls of adjacent individual compartments that face one another.

The water impermeable material may be formed from a plastic, for example polypropylene or polyethylene.

In the linear arrangement discussed above, the multi-compartmental foldable barrier structure has two long sides, which extend along the length of all of the individual compartments and two short sides, which are equal to the depth of a single compartment. In this embodiment, a continuous length of water impermeable material may extend along at least one of the long sides. The fastening means for fastening the multi-compartmental foldable barrier structure to a second multi-compartmental foldable barrier structure is preferably at one or both ends of the long side and may be placed on the long side and/or on the short side.

The flood defence barrier is preferably water impermeable along the entirety of one of its sides. This means that the point at which a first multi-compartmental foldable barrier structure is fastened to a second multi-compartmental foldable barrier structure is water impermeable. In the linear embodiment discussed above, this side is preferably one of the long sides. The opposite side of the multi-compartmental foldable barrier structure to the water impermeable side is preferably water permeable. This means that the floodwater will be stopped by the barrier, but that any water that does leak into the individual compartments can then escape.

In a further embodiment, the water impermeable side is differently coloured to the opposite side. This allows easy identification of the direction in which the barrier should face, as well as making it obvious that one of the multi-compartmental foldable barrier structure in a barrier comprising multiple barrier structures has been placed the incorrect way round. Additionally or alternatively, the fastening means for fastening the first multi-compartmental foldable barrier structure to the second multi-compartmental foldable barrier structure may be arranged such that it is not possible to attach two multi-compartmental foldable barrier structures in the wrong configuration.

The first, non-releasable fastening means may comprise screws, nails, clamps and the like. Alternatively, the first, non-releasable fastening means may comprise a water impermeable material extending along a side of the multi-compartmental foldable barrier structure, which may be connected to at least some of the individual compartments by stitches, staples or the like. This side may be an external side of the multi-compartmental foldable barrier structure and may also be a side perpendicular to a side of an individual compartment which is adjacent to another individual compartment. In the linear embodiment discussed above, this side is preferably one of the long sides. In one embodiment, a second length of material extends along a side opposite that along which the water impermeable material extends. This second material may be water permeable. The water impermeable material may be used to connect all of the individual compartments in the barrier. The water impermeable material preferably extends along a side of every individual compartment in the barrier.

The water impermeable material may extend beyond the side of the multi-compartmental foldable barrier structure such that it can cover the fastening means for fastening the first multi-compartmental foldable barrier structure to the second multi-compartmental foldable barrier structure. In one embodiment, the material comprises the fastening means to attach the first multi-compartmental foldable barrier structure to a second multi-compartmental foldable barrier structure. Preferably, the material may extend underneath the or each multi-compartmental foldable barrier structure. This reduces the leakage through the barrier, by reducing the formation of channels in the ground caused by the water and thereby reducing the passage of floodwater underneath the barrier. It may therefore be preferable to include a separate section of material on the water impermeable side of the multi-compartmental foldable barrier structure that extends underneath the barrier.

The fastening means for fastening the first multi-compartmental foldable barrier structure to the second multi-compartmental foldable barrier structure may comprise screws, nails, clamps and the like. The fastening means for fastening the first multi-compartmental foldable barrier structure to the second multi-compartmental foldable barrier structure may also or alternatively comprise means that can be unfastened without destruction of the means, such that the means can be re-fastened after said unfastening. In one embodiment, the fastening means for fastening the first multi-compartmental foldable barrier structure to the second multi-compartmental foldable barrier structure may be one or more of a zip, buckles or other arrangements such as Velcro® or eyelets and cable ties. The fastening means for fastening the first multi-compartmental foldable barrier structure to the second multi-compartmental foldable barrier structure may be water impermeable. A plurality of buckles may be used and preferably, two or three buckles are used. Such fastening means are generally expensive and so incorporating these fastening means once every multi-compartmental foldable barrier structure reduces cost compared to barriers in which a fastening means is included between each individual compartment. The fastening means is preferably covered by a section of material, which is preferably water impermeable and acts to further reduce leakage through the barrier. This section of material may or may not comprise the water impermeable material, as discussed above. The same or different fastening means may be used at each point where the fastening means is present.

Preferably, both buckles and a zip are used. The buckles may be attached to each end of two multi-compartmental foldable barrier structures and may take a majority of the stress of holding the two barriers together, which would make it easier to close the zip. The zip may be attached to a section of material covering the buckles and provides improved water impermeability as well as an additional fastening means. The section of material may or may not comprise the water impermeable material of one or both of the multi-compartmental foldable barrier structures.

When the fastening means is present on the water impermeable material, the fastening means itself preferably acts to create a water impermeable seal. For example, water impermeable zips such as the MaxiGrip MX 20 can be used.

The fastening means for fastening the first multi-compartmental foldable barrier structure to the second multi-compartmental foldable barrier structure may be provided only on one side of the multi-compartmental foldable barrier structure. Alternatively, the fastening means for fastening the first multi-compartmental foldable barrier structure to the second multi-compartmental foldable barrier structure are provided on opposite sides of the multi-compartmental foldable barrier structures. In the linear embodiment discussed above, the water impermeable material may extend along one or both of the long sides. The fastening means for fastening the first multi-compartmental foldable barrier structure to the second multi-compartmental foldable barrier structure may be present on one or both of the short sides, or on the long side close to one or both of the short sides. Additionally or alternatively, the fastening means for fastening the first multi-compartmental foldable barrier structure to the second multi-compartmental foldable barrier structure may be present on one or both of the long sides, or on the short side close to one or both of the long sides.

Additionally, there may also be fastening means (releasable or otherwise) as described above between adjacent individual compartments within the or each multi-compartmental foldable barrier structure. This may provide increased strength and stability to the barrier and such fastening means may also be used to pull the compartments together before they are filled, and/or while (in the case of a releasable fastening) making it easier to remove the individual compartments separately from the multi-compartmental foldable barrier structure when disassembling the flood defence barrier. For example in some embodiments of the invention releasable fastening means, such as buckles or zips, may be provided between individual compartments in the or each multi-compartmental foldable barrier structure. Conveniently, such fastening means may be provided on the compartments on the opposite side of the barrier from the continuous sheet of water impermeable material.

To further reduce leakage, the flood defence barrier of the present invention may further comprise a compressible member extending at least part of the distance from the top to the bottom of at least one side of the multi-compartmental foldable barrier structure. Additionally or alternatively, the flood defence barrier may comprise a compressible member extending at least part of the distance along the base of at least one side of the multi-compartmental foldable barrier structure. In the linear embodiment discussed above, the compressible member is preferably on one or both of the short sides of the multi-compartmental foldable barrier structure.

Said compressible member may comprise foam and may further comprise a hollow foam tube. Preferably, the compressible member is resiliently compressible. In a further embodiment, a compressible member extending at least part of a distance along one side of a multi-compartmental foldable barrier structure is offset from a compressible member extending at least part of a corresponding distance along an adjacent side of a second multi-compartmental foldable barrier structure when the two are attached by a fastening means for fastening the first multi-compartmental foldable barrier structure to the second multi-compartmental foldable barrier structure.

The compressible member is preferably compressed against a surface adjacent the side of the multi-compartmental foldable barrier structure (which may be another multi-compartmental foldable barrier structure) as the individual compartment on which it is placed is filled with a fill material. This acts to further decrease leakage as the compressible member forms a water impermeable seal. Preferably, leakage is reduced by around 10%.

The flood defence barrier according to the present invention may comprise any number of multi-compartmental foldable barrier structures. Preferably, there are more than two multi-compartmental foldable barrier structures. This provides a barrier of adjustable length, depending on the requirements of the deployment site.

Also discussed is a method for deploying a flood defence barrier according to the present invention, comprising transporting the folded multi-compartmental foldable barrier structure to a deployment site, unfolding the multi-compartmental foldable barrier structure and filling each individual compartment with a fill material, before or after which the multi-compartmental foldable barrier structure is attached to another group of one or more individual compartments by the fastening means for fastening the first multi-compartmental foldable barrier structure to the second multi-compartmental foldable barrier structure. In an embodiment, an individual compartment at the end of the flood defence barrier is filled with a fill material and tension is subsequently applied to the opposite end of the flood defence barrier so as to unfold and erect the multi-compartmental foldable barrier structure. Alternatively, the multi-compartmental foldable barrier structures may be provided at the deployment site erected and optionally also filled.

When the flood defence barrier of the present invention is to be removed, the fastening means for fastening the first multi-compartmental foldable barrier structure to the second multi-compartmental foldable barrier structure may be released, so as to separate the multi-compartmental foldable barrier structures. In an embodiment, the water impermeable material is destroyed so as to separate the individual compartments. Each individual compartment may then be removed and taken away from the site separately. The fill material in each individual compartment may be released at the site, or may be released once the individual compartment has been taken away from the site.

Also discussed is the use of a flood defence barrier according to the present invention as a barrier against elemental forces, such as flooding.

Another aspect of the present invention provides a use of the foldable barrier structure discussed above for military or civil fortification, personnel protection or flood or environmental defence. Environmental defence is intended to encompass any use in which the barrier prevents erosion of an environment.

Any of the above embodiments of the present invention may further comprise a lid extending at least partially over the top of one or more of the compartments. This lid prevents the fill material from accidentally being removed from the compartment, for example by water or wind. Removal of the fill material would mean that the barrier structure becomes lighter and so can be more easily displaced.

Preferably, the lid extends over the entirety of the top of the compartment. The lid may be fastened to the compartment using any suitable means. The lid itself may comprise any suitable material. In one embodiment, the lid is at least partially formed by the water impermeable material extending from the side of the barrier at least partially over the top of the barrier. In this embodiment, at least a portion of the impermeable material may be taller than the one or more compartments along which it extends, so that it can reach over the top of one or more of the compartments, thereby creating a lid.

Any of the above embodiments of the present invention may also include a reflective material, which increases the visibility of the barrier in the dark. Preferably, this reflective material is on the rear of the barrier, on the opposite side to the water impermeable material. The reflective material may be at any suitable position, such as on the lifting means, the lid or the individual compartments themselves.

One or more embodiments of the invention are described further hereinafter, by way of example only, with reference to the accompanying drawings in which:

FIG. 1 demonstrates the top view of a multi-compartmental foldable barrier structure;

FIG. 2 demonstrates the front view of the multi-compartmental foldable barrier structure as shown in FIG. 1, adjacent to a second multi-compartmental foldable barrier structure;

FIG. 3 demonstrates the back view of the multi-compartmental foldable barrier structure as shown in FIG. 1, adjacent to a second multi-compartmental foldable barrier structure;

FIG. 4 demonstrates the top view of a multi-compartmental foldable barrier structure adjacent to another multi-compartmental foldable barrier structure and further comprising compressible members;

FIG. 5 demonstrates the side view of a multi-compartmental foldable barrier structure adjacent to another multi-compartmental foldable barrier structure and further comprising compressible members;

FIG. 6 shows the flood barrier of the present invention when deployed against floodwater;

FIG. 7 demonstrates the multi-compartmental foldable barrier structure shown in FIG. 1, further comprising stiffening means;

FIG. 8 demonstrates the front view of the multi-compartmental foldable barrier structure shown in FIG. 2, further comprising means for preventing a fill material from falling between adjacent individual compartments;

Figure 14:
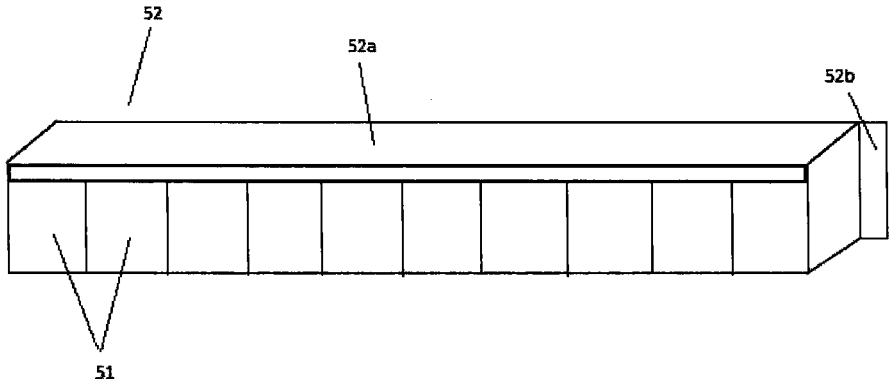
Figure 15:
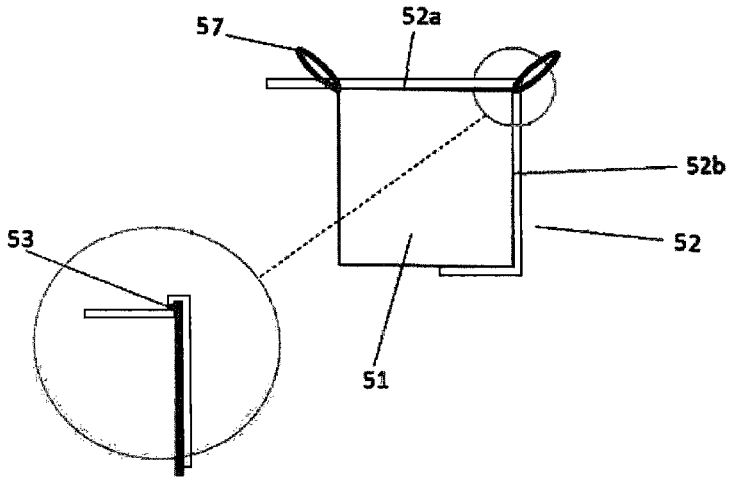

FIG. 14 demonstrates a rear view of a further embodiment of the present invention, comprising a lid extending over the top of the individual compartments; and FIG. 15 demonstrates a side view of one of the individual compartments shown in FIG. 14.

Figure 1:
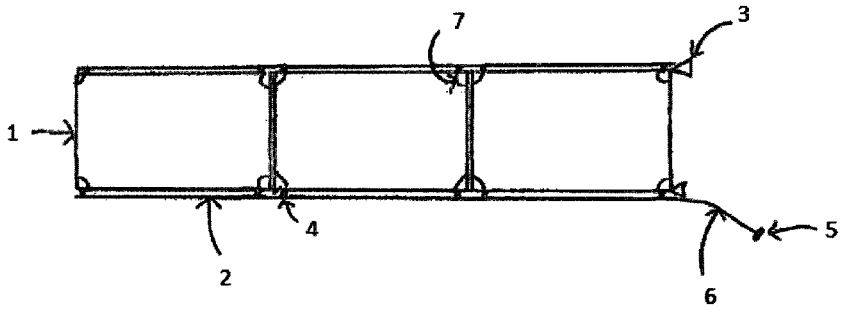

Looking at the drawings in more detail, FIG. 1 demonstrates the top view of a multi-compartmental foldable barrier structure, connected by a continuous length of water impermeable material 2. In this embodiment, the water impermeable material 2 comprises stitches 4 to attach the material to the individual compartments 1. Fastening means 3 are present on the end compartment of the multi-compartmental foldable barrier structure, in the form of buckles. An additional fastening means is shown as a zip 5 on the end of a section of material 6, which is an extension of the water impermeable material 2. Also illustrated are lifting means 7, in the form of handles at each corner of the individual compartments 1. The stiffening means are not shown in this figure.

Figure 2:
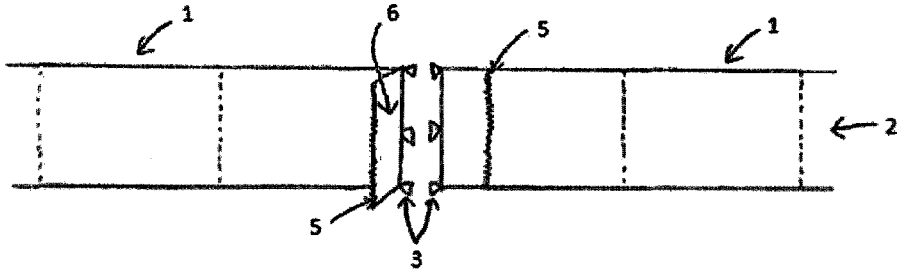

FIG. 2 demonstrates the front view of the multi-compartmental foldable barrier structure as shown in FIG. 1, adjacent to a second multi-compartmental foldable barrier structure. The individual compartments 1 in each barrier are connected by a water impermeable material 2. The fastening means 3 (in this case comprising three buckles) are present on both end compartments of each multi-compartmental foldable barrier structure. The section of material 6 will extend over the fastening means 3 and will be attached to the adjacent multi-compartmental foldable barrier structure using the zip 5, thereby reducing leakage of floodwater between the multi-compartmental foldable barrier structures.

Figure 3:
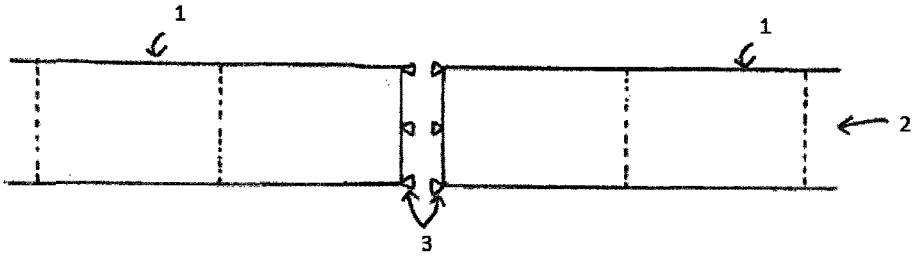

FIG. 3 demonstrates the back view of the multi-compartmental foldable barrier structure as shown in FIG. 1, adjacent to a second multi-compartmental foldable barrier structure. The individual compartments 1 in each barrier are connected by a water impermeable material 2. The fastening means 3 (in this case comprising three buckles) are present on both end compartments of each multi-compartmental foldable barrier structure.

Figure 4:
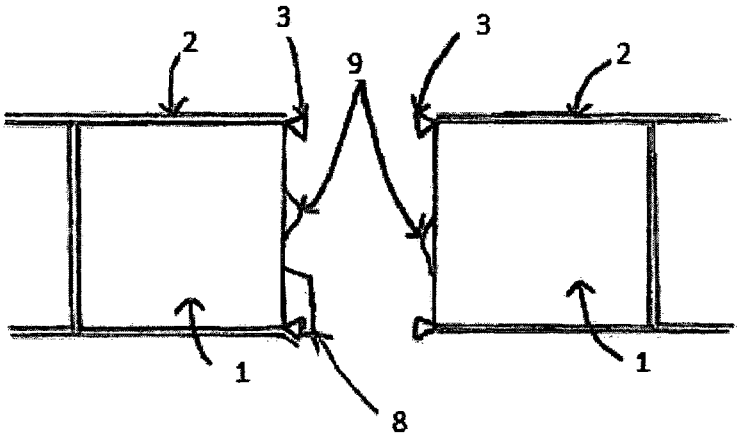

FIG. 4 demonstrates the top view of a multi-compartmental foldable barrier structure adjacent to another multi-compartmental foldable barrier structure, each of which are connected by a water impermeable material 2. Both individual compartments 1 comprise a fastening means 3. Each individual compartment 1 further comprises a compressible member 9 extending the distance from the top to the bottom of the side of the individual compartment 1. In this embodiment, the two compressible members 9 are offset from one another. One of the individual compartments 1 further comprises a compressible member 8 extending part of the distance along the base of the individual compartment 1.

Figure 5:
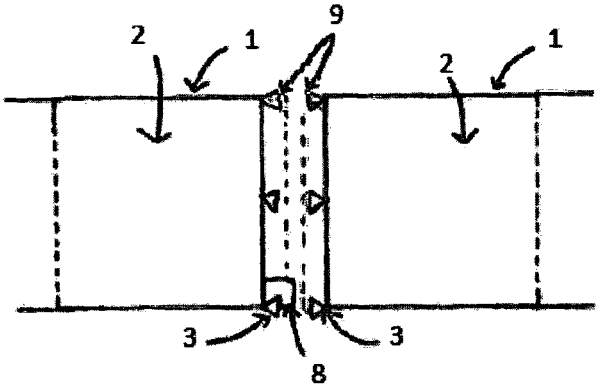

FIG. 5 demonstrates the side view of the multi-compartmental foldable barrier structure as demonstrated in FIG. 4. Again, this figure shows a multi-compartmental foldable barrier structure adjacent to another multi-compartmental foldable barrier structure, each of which are connected by a water impermeable material 2. Both individual compartments 1 comprise a fastening means 3. Each individual compartment 1 further comprises a compressible member 9 extending the distance from the top to the bottom of the side of the individual compartment 1. One of the individual compartments 1 further comprises a compressible member 8 extending part of the distance along the base of the individual compartment 1.

Figure 6:
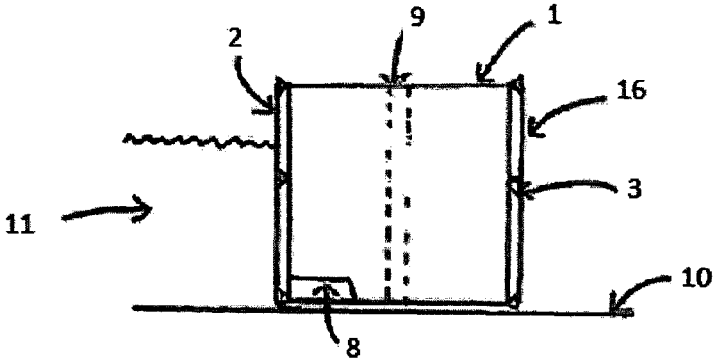

FIG. 6 shows the flood barrier of the present invention when deployed against floodwater 11. The individual compartment 1 is placed on the ground 10, with the water impermeable material 2 facing the floodwater 11. An opposite length of material 16 extends along the side opposite the water impermeable material and is preferably water permeable. In this embodiment, a section of the water impermeable material 2 extends underneath the individual compartment 1 to further reduce leakages. The two compressible members 8, 9 are also illustrated.

Figure 7:
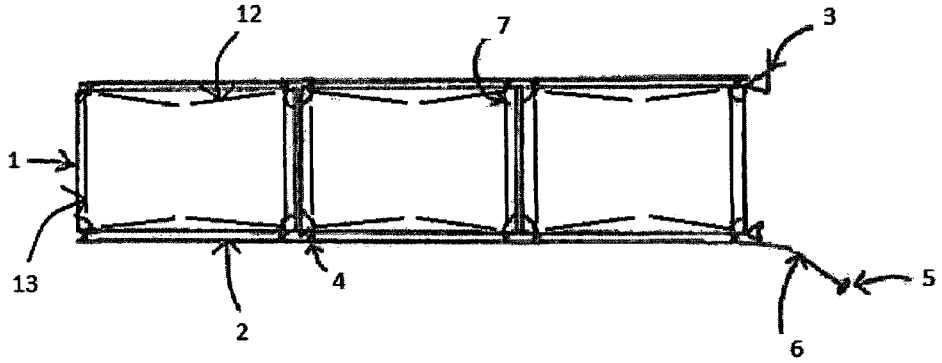

FIG. 7 demonstrates the multi-compartmental foldable barrier structure shown in FIG. 1 comprising stiffening means 12, 13. Stiffening means 13 extend along the side walls of the individual compartments adjacent to another individual compartment and comprise a single panel placed against the inside of the side wall. Stiffening means 12 extend along the side walls perpendicular to the side walls adjacent to another individual compartment. Two stiffening means 12 are placed adjacent one another to extend along the full length of the inside of the side wall. A means for receiving a hinge member is provided by the material of the side wall, in between the two stiffening means. This allows the perpendicular side wall to fold in the central region, allowing the multi-compartmental foldable barrier structure to collapse.

Figure 8:
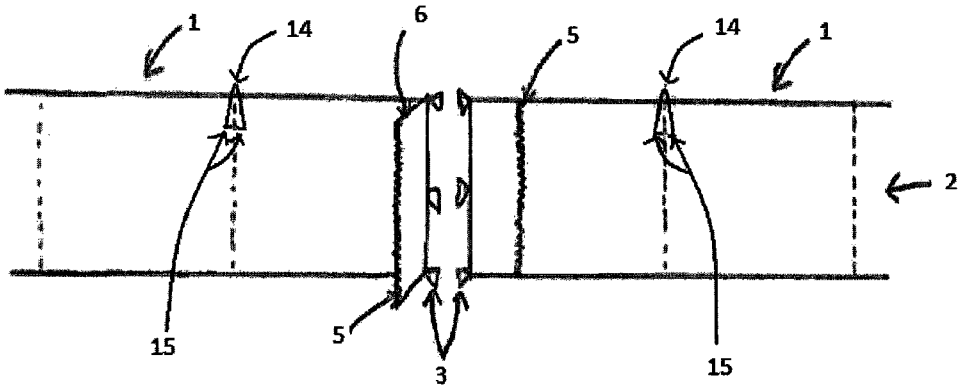

FIG. 8 demonstrates the front view of the multi-compartmental foldable barrier structure shown in FIG. 2, further comprising a means for preventing a fill material from falling between adjacent individual compartments 14. The means 14 comprises a material extending between adjacent individual compartments 1 and fastened to the inside of each of the adjacent side walls. The means 14 is fastened by fastening means 15, which may comprise stitches or staples.

Figure 9:
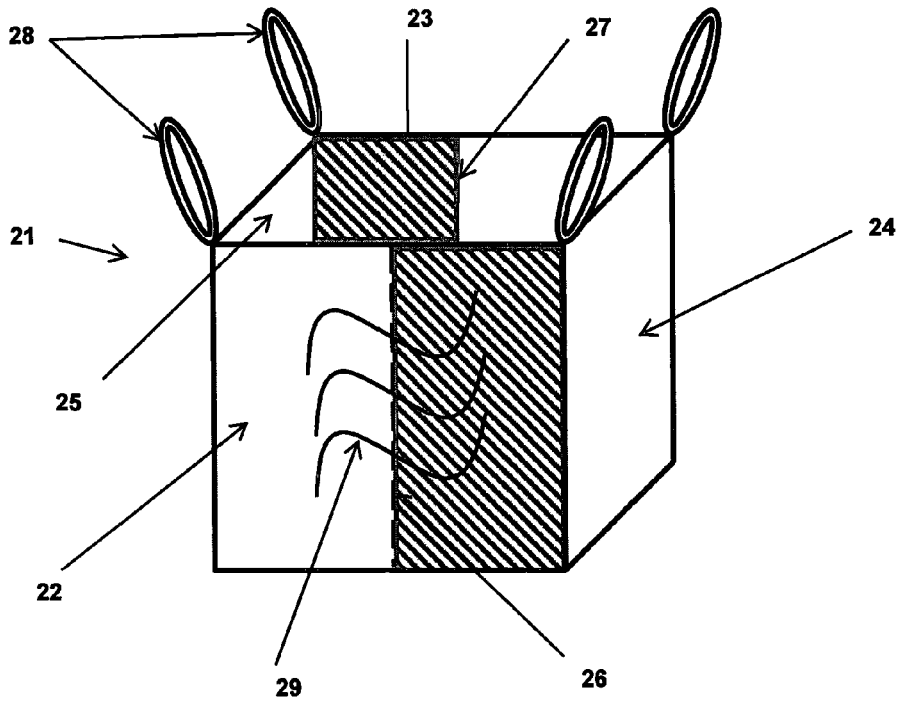
FIG. 9 shows a perspective view of a collapsible bag according to the present invention.

FIG. 9 shows a perspective view of a cube-shaped collapsible bag 21 having an open fillable compartment being bounded at its front by a front wall 22, and at its rear by a rear wall 23, at its sides by respective side walls 24, 25 and at its base by a base wall (not shown). Pockets (not shown) are formed in the front wall 22, rear wall 23 and side wall 24, and fully extend over the respective walls. Two separate pocket sections are created in the pockets formed in the front wall 22 and rear wall 23 using stitching 26, 27 vertically down the middle of the walls. A stiffening member (not shown) is positioned within the pocket formed in the side wall 24 and in one of the two pocket sections in the front wall 22 and rear wall 23 such that they are diagonally opposite one another, shown by the shaded regions. The stiffening member is a complementary shape to the pocket. Four handles 28 are located at the each of the four corners on the top edge of the collapsible bag 21 i.e. at the opening of the compartment, to aid transportation of the collapsible bag. Markings 29 are added to the front wall 22 to distinguish the orientation of the collapsible bag. The collapsible bag 21 is self-supporting.

Figure 10:
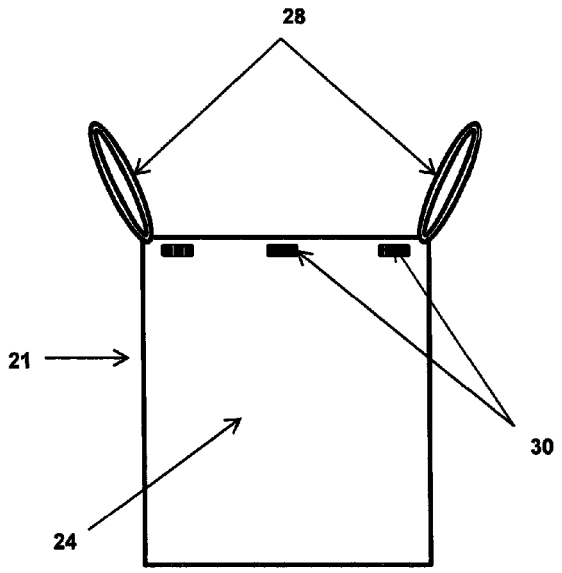
FIG. 10 shows a side view of a collapsible bag showing the fastening means for connecting the collapsible bag to another collapsible bag.

FIG. 10 shows a side view of the cube-shaped collapsible bag 21 having staples 30 through the top edge of side wall 24. The staples 30 are used to connect the collapsible bag 21 to a respective side wall of an adjacent collapsible bag (not shown).

Figure 11:
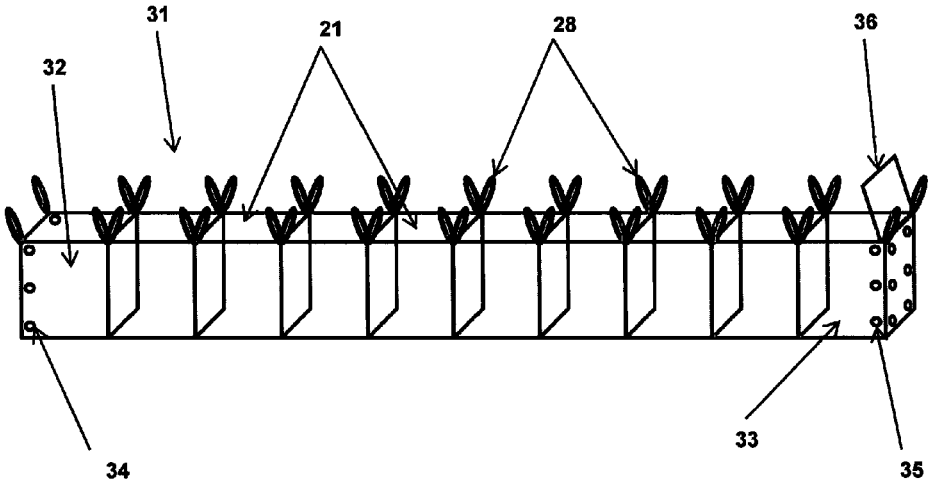
FIG. 11 shows a collapsible barrier comprising a plurality of connected or attached collapsible bags with releasable fastening means in the end bags.

FIG. 11 shows a collapsible barrier 31 comprising a plurality of connected or attached collapsible bags 21 bounded by two collapsible, end bags 32, 33. The collapsible bags are arranged side-by-side so as to form a line of individual collapsible bags that is one bag deep. The collapsible bags are connected or attached using staples as shown in FIG. 10. The collapsible barrier 31 is connectable or attachable to a second collapsible barrier (not shown) adjacent thereto at either or both ends, to provide and extended barrier. The collapsible barrier 31 is connectable or attachable to the second collapsible barrier by releasable fastening means in the form of eyelets 34, 35 provided on end bags 32, 33 respectively, and cable ties (not shown). One of the end bags 33 is provided with a flap of material 36 extending from the top edge thereof. The flap of material 36 is configured to extend between the end bag 33 and an end bag in a second collapsible barrier to prevent fill material from falling between adjacent collapsible barriers. The collapsible barrier 31 is self-supporting.

Figure 12:
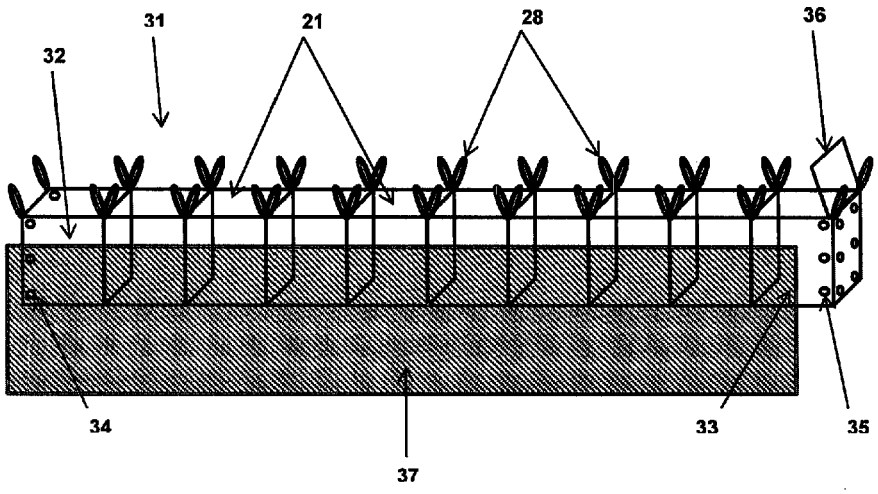
FIG. 12 shows a collapsible barrier comprising a water impermeable material along one side thereof.

FIG. 12 shows the collapsible barrier 31 additionally comprising a continuous water impermeable material 37 along one side thereof. The continuous water impermeable material 37 is fastened to the collapsible barrier 31 using stitching across the top edge of the collapsible bags 21, 32, 33. At one end of the collapsible barrier 31, the continuous water impermeable material 37 extends beyond the end bag 32 in an amount equal to the width of one collapsible bag. At the other end of the collapsible barrier 31, the continuous water impermeable material 37 ends in-line with the end bag 33. In addition, the continuous water impermeable material extends below the base of the collapsible barrier 31. This enables the continuous water impermeable material 37 to be folded underneath the collapsible barrier 31 and be fastened thereto using staples (not shown).

Figure 13:
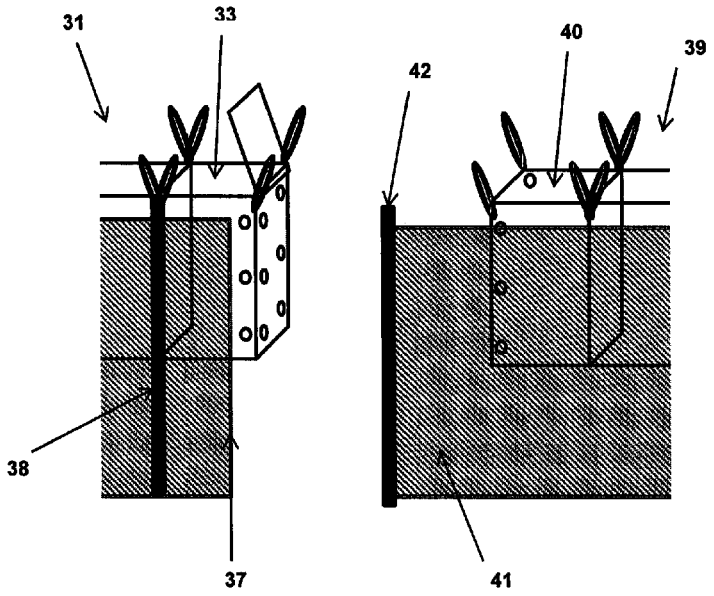
FIG. 13 shows releasable fastening means for connecting or attaching two collapsible barriers via a water impermeable material.

FIG. 13 shows an end portion of collapsible barrier 31 as described in FIG. 12 and an end portion of a second collapsible barrier 39 which has the same overall construction as collapsible barrier 31. The water impermeable material 37, 41 can be used to connect or attach one end of the collapsible barrier 31 to the opposite end of the second collapsible barrier 39, in addition to the releasable fastening means in the form of eyelets in the respective end bags 33, 40.

A Velcro® strip 38 is attached to the outside surface of the continuous water impermeable material 37. A complementary Velcro® strip 42 is attached to the inside surface of the continuous water impermeable material 41. When the collapsible barrier 31 and the second collapsible barrier 39 are brought together such that the respective end bags 33, 40 are adjacent to one another, the complementary Velcro® strips 38, 42 connect or attach the two collapsible barriers together.

FIG. 14 demonstrates a rear view of a plurality of individual compartments 51 according to a further aspect of the present invention, which comprises a lid 52 extending over the top of each of the individual compartments 51. Lid 52 comprises a top portion **52*a* and a front portion 52*b* that extends along the front side of the individual compartments 51. The front portion 52*b* is a water impermeable material comprising polyethene that extends along the front side of the individual compartments 51. The lid 52 then reaches over the top of the individual compartments 51 to form the top portion 52*a*, so that the front portion 52*b* and the top portion 52*a* are continuous. It is this top portion 52*a* that prevents the fill material from accidentally being removed from the individual compartment 51. The edge of the top portion 52***a* furthest away from the front portion 52*b* is then attached to the individual compartments 51 by Velcro.

FIG. 15 demonstrates a side view of one of the plurality of individual compartments 51 shown in FIG. 14. Front portion 52*b* of the lid 52 is shown extending along the height of the individual compartment 51 and underneath it. This provides a means for anchoring the lid material, as well as providing a waterproof front to the individual compartment 51. Front portion 52*b* also extends over the top of the individual compartment 51 to form the top portion 52*a* of the lid 52. Also shown are lifting means 57 in the form of handles at either side of the individual compartment 51.

FIG. 15 also demonstrates an enlarged view of the top corner of the individual compartment 51, in which the material of the lid 52 extends over the top of the individual compartment 51 and is stapled to the inside thereof using staples 53.

The invention claimed is:

1. A flood defence barrier, comprising:

first and second multi-compartmental barrier structures, each of the first and second multi-compartmental barrier structures comprising a multiplicity of compartments, each compartment bounded by a pair of opposed side walls and a pair of opposed end walls, at least one pair of opposed side or end walls being formed from a flexible, foldable material incorporating a stiffening element, and a hinge member which permits folding of a central region of each opposed side or end wall of the at least one pair of side or end walls, and fastening means for fastening the first-compartmental foldable barrier structure to the second multi-compartmental foldable barrier structure, wherein the hinge member comprises a portion of the flexible, foldable material, wherein two layers of the flexible, foldable material are joined in the central region in compartments of the first and/or second multi-compartmental barrier structures, wherein each pair of opposed side or end walls in the compartments of the first and/or second multi-compartmental barrier structures only comprises two sections of the stiffening element, one on a first wall and one on a second wall, and wherein the compartments are connected, affixed or adhered to one another end to end.

2. The flood defence barrier according to claim 1, wherein the first multi-compartmental foldable barrier structure is connected by a first, non-releasable fastening means, wherein the multi-compartmental foldable barrier structure comprises at least one second, releasable, fastening means effective for releasably fastening the first multi-compartmental foldable barrier structure to a second multi-compartmental foldable barrier structure; and/or wherein the opposite side of the multi-compartmental foldable barrier structures to the water impermeable side is water permeable; and/or wherein the material extends beyond the side of the multi-compartmental foldable barrier structure such that it can cover the fastening means for fastening the first multi-compartmental foldable barrier structure to a second multi-compartmental foldable barrier structure; and/or wherein the material comprises the fastening means for fastening the first multi-compartmental foldable barrier structure to a second multi-compartmental foldable barrier structure; and/or wherein the material extends underneath the multi-compartmental foldable barrier structure; and/or wherein the fastening means for fastening the first multi-compartmental foldable barrier structure to the second multi-compartmental foldable barrier structure comprises a zip and/or buckles.

3. The flood defence barrier according to claim 1, further comprising a compressible member extending at least part of the distance from the top to the bottom of at least one side of the first and/or second multi-compartmental foldable barrier structures and/or comprising a compressible member extending at least part of the distance along the base of at least one side of at least one of the first and/or second multi-compartmental foldable barrier structures.

4. The flood defence barrier according to claim 1, further comprising a lid extending at least partially over the top of at least one of the individual compartments, optionally wherein the lid is at least partially formed by the water impermeable material extending from the side of a multi-compartmental barrier structure at least partially over the top of the barrier structure.

5. A flood defense barrier, comprising:

first and second multi-compartmental barrier structures, each of the first and second multi-compartmental barrier structures comprising a multiplicity of compartments, each compartment bounded by a pair of opposed side walls and a pair of opposed end walls, at least one pair of opposed side or end walls being formed from a flexible, foldable material incorporating a stiffening element, and a hinge member which permits folding of a central region of each opposed side or end wall of the at least one pair of side or end walls;

a compressible member extending at least part of the distance from the top to the bottom of at least one side of the first and/or second multi-compartmental foldable barrier structure and/or comprising a compressible member extending at least part of the distance along the base of at least one side of the first and/or second multi-compartmental barrier structure; and fastening means for fastening the first-compartmental foldable barrier structure to the second multi-compartmental foldable barrier structure;

wherein the hinge member comprises a portion of the flexible, foldable material, wherein two layers of the flexible, foldable material are joined in the central region of a compartment in the first and/or second multi-compartmental barrier structures, wherein the pair of opposed side or end walls only comprises two sections of the stiffening element, one on a first wall and one on a second wall, wherein the compartments are connected, affixed or adhered to one another end to end, and wherein the compressible member comprises foam and/or wherein the compressible member is resiliently compressible and/or wherein a compressible member extending at least part of the distance along one side of a multi-compartmental foldable barrier structure is offset from a compressible member extending at least part of the distance along an adjacent side of another group of one or more individual compartments when the two are attached by the fastening means.

6. A multi-compartmental foldable barrier structure comprising a multiplicity of compartments, each compartment bounded by a pair of opposed side walls and a pair of opposed end walls, at least one pair of opposed side or end walls being formed from a flexible, foldable material incorporating a stiffening element, and a hinge member which permits folding of a central region of each opposed side or end wall of the at least one pair of side or end walls, and a means for preventing a fill material from falling between adjacent individual compartments, wherein the means comprises a material extending between the compartments and fastened to the inside of each of the side walls adjacent to the other individual compartment, wherein the hinge member comprises a portion of the flexible, foldable material, wherein two layers of the flexible, foldable material are joined in the central region, wherein the pair of opposed side or end walls only comprises two sections of the stiffening element, one on a first wall and one on a second wall, and wherein the compartments are connected, affixed or adhered to one another end to end.

7. A flood defense barrier, comprising:

first and second multi-compartmental barrier structures, each of the first and second multi-compartmental barrier structures comprising a multiplicity of compartments, each compartment bounded by a pair of opposed side walls and a pair of opposed end walls, at least one pair of opposed side or end walls being formed from a flexible, foldable material incorporating a stiffening element, and a hinge member which permits folding of a central region of each opposed side or end wall of the at least one pair of side or end walls, and fastening means for fastening the first-compartmental foldable barrier structure to the second multi-compartmental foldable barrier structure, wherein the hinge member comprises a portion of the flexible, foldable material, wherein two layers of the flexible, foldable material are joined in the central region, wherein the pair of opposed side or end walls only comprises two sections of the stiffening element, one on a first wall and one on a second wall, wherein the compartments are connected, affixed or adhered to one another end to end, wherein the flood defense barrier is water impermeable along one side and is water permeable along the opposite side of the flood defense barrier; and wherein the flood defence barrier comprises one or more features selected from the group consisting of:

wherein a first multi-compartmental foldable barrier structure connected by a first, non-releasable fastening means, wherein the multi-compartmental foldable barrier structure comprises at least one second, releasable, fastening means effective for releasably fastening the first multi-compartmental foldable barrier structure to a second multi-compartmental foldable barrier structure;

wherein the opposite side of the multi-compartmental foldable barrier structures to the water impermeable side is water permeable;

wherein the material extends beyond the side of the multi-compartmental foldable barrier structure such that it can cover the fastening means for fastening the first multi-compartmental foldable barrier structure to a second multi-compartmental foldable barrier structure;

wherein the material comprises the fastening means for fastening the first multi-compartmental foldable barrier structure to a second multi-compartmental foldable barrier structure;

wherein the material extends underneath the multi-compartmental foldable barrier structure; and wherein the fastening means for fastening the first multi-compartmental foldable barrier structure to the second multi-compartmental foldable barrier structure comprises a zip and/or buckles.

* * * * *